US006734888B1

(12) United States Patent
Mindler et al.

(10) Patent No.: US 6,734,888 B1
(45) Date of Patent: May 11, 2004

(54) APPARATUS AND METHOD FOR DETERMINING MISMATCH INVOLVING AVAILABILITY OF DYE DONOR AND RECEIVER SUPPLIES IN THERMAL PRINTER

(75) Inventors: Robert F. Mindler, Churchville, NY (US); Theodore J. Skomsky, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/355,919

(22) Filed: Jan. 31, 2003

(51) Int. Cl.[7] ..... B41J 17/36; B41J 35/36; B41J 29/46

(52) U.S. Cl. ..... 347/217; 400/249; 400/703; 400/247; 400/712

(58) Field of Search ..... 347/217; 400/247, 400/249, 703, 712

(56) References Cited

U.S. PATENT DOCUMENTS 5,555,012 A * 9/1996 Ellson et al. ..... 347/217
5,691,961 A * 11/1997 Paranjpe ..... 347/217
6,437,814 B1 * 8/2002 Shimonaga et al. ..... 347/217

FOREIGN PATENT DOCUMENTS

JP 06067507 * 3/1994 ..... B41J/35/36
JP 2000006450 * 1/2000 ..... B41J/17/36

* cited by examiner

*Primary Examiner*—Huan Tran
(74) *Attorney, Agent, or Firm*—Roger A. Fields

(57) ABSTRACT

A method for determining a mismatch involving the availability of a dye donor supply and a dye receiver supply in a thermal printer when a particular print size and print quantity are selected, comprises: comparing a remaining number of similar-size donor patches available on the dye donor supply with a remaining number of like-size donor patches required for the selected print size and print quantity, and should the former number be less than the latter number providing a warning; and comparing a remaining length of dye receiver available on the dye receiver supply with a remaining length of dye receiver required for the selected print size and print quantity, and should the former length be less than the latter length providing a warning.

11 Claims, 4 Drawing Sheets

APPARATUS AND METHOD FOR DETERMINING MISMATCH INVOLVING AVAILABILITY OF DYE DONOR AND RECEIVER SUPPLIES IN THERMAL PRINTER

FIELD OF THE INVENTION

The invention relates generally to thermal printers, and in particular to one in which a mismatch involving the availability of a dye donor supply and a dye receiver supply can be determined—in which case the printing operation should be suspended and the short supply replenished to establish a match.

BACKGROUND OF THE INVENTION

A typical dye donor web that is used in a thermal printer includes a repeating series of three different primary color sections or patches such as a yellow color patch, a magenta color patch and a cyan color patch. Also, there may be a transparent colorless laminating section or patch after the cyan color patch.

To make a color image print using a thermal printer, respective color dyes in a single series of yellow, magenta and cyan color patches on a dye donor web are successively heat-transferred, one over the other, onto a dye receiver sheet. Then, optionally, a transparent laminating material on a laminating patch of the web is heat-transferred onto the color image print. The dye transfer from each color patch to the dye receiver sheet is done one line of pixels at a time via a bead of selectively used heating or resistor elements on a thermal print head.

One example of a color image print-making process using a thermal printer is as follows.

1. A dye donor web and a dye receiver sheet are advanced forward in unison, with a yellow color patch of the donor web moving in contact with the receiver sheet longitudinally over a stationary bead of heating elements in order to effect a line-by-line yellow dye transfer from the yellow color patch to the receiver sheet. A web take-up spool draws the dye donor web forward over the bead of heating elements, and a pair of pinch and drive rollers draw the dye receiver sheet forward over the bead of heating elements. A platen roller holds the dye receiver sheet in a dye receiving relation with the dye donor web at the bead of heating elements.

2. Once the yellow dye transfer is completed, the platen roller is retracted from adjacent the print head to allow the pair of pinch and drive rollers to return the dye receiver sheet rearward in preparation for a second pass over the bead of heating elements.

3. Then, the platen roller is returned to adjacent the print head, and the dye donor web and the dye receiver sheet arc advanced forward in unison, with a magenta color patch of the donor web moving in contact with the receiver sheet longitudinally over the bead of heating elements in order to effect a line-by-line magenta dye transfer from the magenta color patch to the receiver sheet. The magenta dye transfer to the dye receiver sheet is in the same area on the receiver sheet as was subjected to the yellow dye transfer.

4. Once the magenta dye transfer is completed, the platen roller is retracted from adjacent the print head to allow the pair of pinch and drive rollers to return the dye receiver sheet rearward in preparation for a third pass over the bead of heating elements.

5. Then, the platen roller is returned to adjacent the print head, and the dye donor web and the dye receiver sheet are advanced forward in unison, with a cyan color patch of the donor web moving in contact with the receiver sheet longitudinally over the bead of heating elements in order to effect a line-by-line cyan dye transfer from the cyan color patch to the receiver sheet. The cyan dye transfer to the dye receiver sheet is in the same area on the receiver sheet as was subjected to the yellow and magenta dye transfers.

6. Once the cyan dye transfer is completed, the platen roller is retracted from adjacent the print head to allow the pair of pinch and drive rollers to return the dye receiver sheet rearward in preparation for a fourth pass over the bead of heating elements.

7. Then, the platen roller is returned to adjacent the print head, and the dye donor web and the dye receiver sheet are advanced forward in unison, with a transparent colorless laminating patch of the donor web moving in contact with the receiver sheet longitudinally over the bead of heating elements in order to effect a line-by-line laminating material transfer from the laminating patch to the receiver sheet. The laminating material is applied to the dye receiver sheet on top of the yellow, magenta and cyan dye transfers to that sheet.

8. Once the laminating material transfer is completed, the platen roller is retracted from adjacent the print head to allow the laminated dye receiver sheet to be returned rearward in preparation for exiting the printer.

9. Finally, the pair of pinch and drive rollers advance the laminated dye receiver sheet forward to an exit tray.

Instead of a dye receiver sheet, the print-making process can involve a dye receiver roll. In this case, each sheet must be cut from the roll.

SUMMARY OF THE INVENTION

According to one aspect of the invention, a method for determining a mismatch involving the availability of a dye donor supply and a dye receiver supply in a thermal printer when a particular print size and print quantity are selected, comprises:

comparing a remaining number of similar-size donor patches available on the dye donor supply with a remaining number of like-size donor patches required for the selected print size and print quantity, and should the former number be less than the latter number providing a warning; and comparing a remaining length of dye receiver available on the dye receiver supply with a remaining length of dye receiver required for the selected print size and print quantity, and should the former length be less than the latter length providing a warning.

According to another aspect of the invention, apparatus is provided for performing the foregoing method.

DETAILED DESCRIPTION OF THE INVENTION

Because the features of a thermal printer are generally known, the description which follows is directed in particular only to those elements forming part of or cooperating directly with the invention. It is to be understood, however, that other elements not disclosed may take various forms known to a person of ordinary skill in the art.

Figure 1:
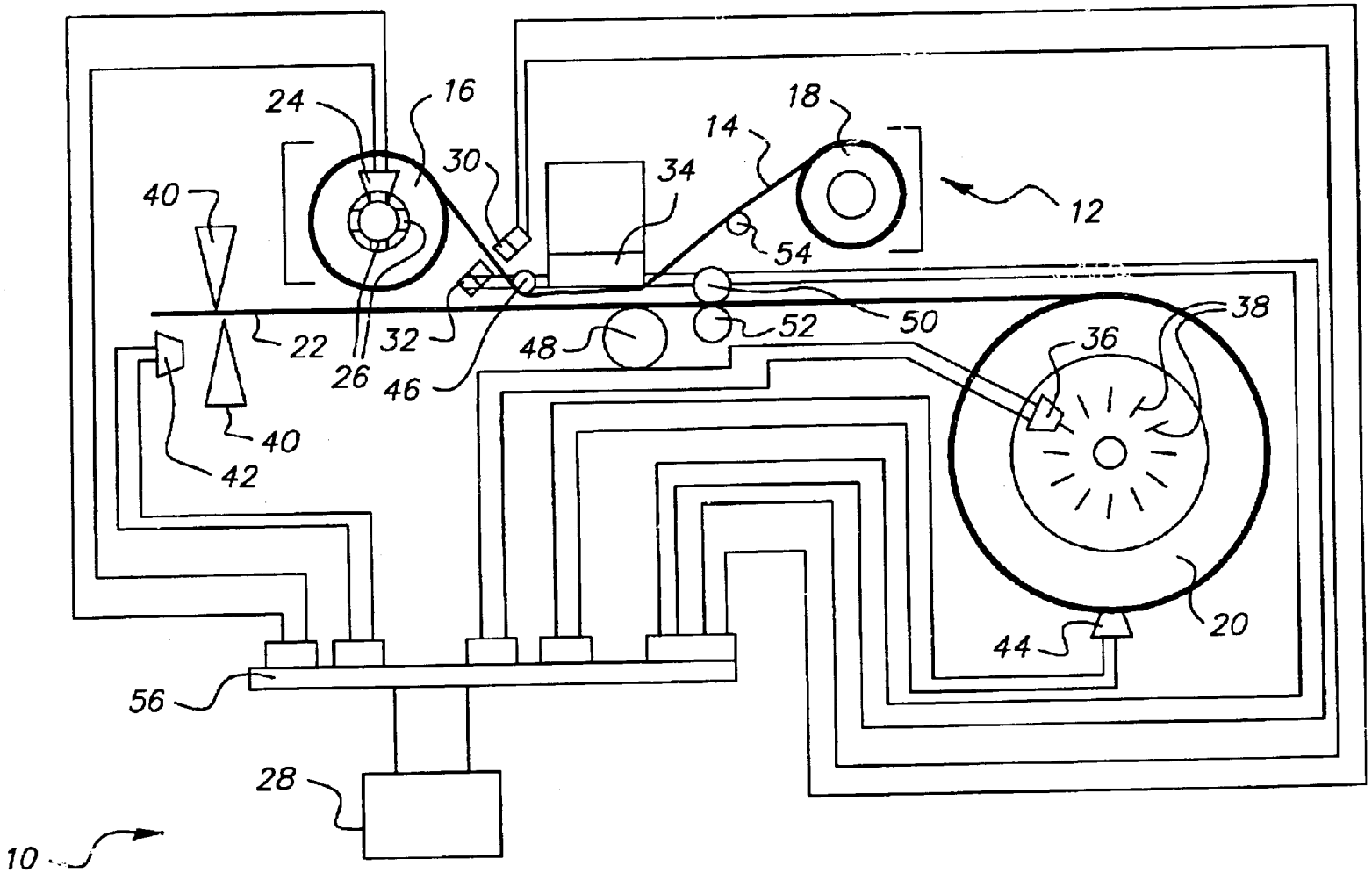
FIG. 1 is a schematic diagram of printer apparatus which is a preferred embodiment of the invention.

Thermal Printer—FIG. 1

FIG. 1 depicts, in part, a thermal printer 10 in which a donor cartridge 12 having a dye donor web 14 intended to be advanced from a rotated (fresh) donor supply roll 16 to a rotated (used) donor take-up roll 18 is loaded. The dye donor web 14 is a conventional one including a repeating series of four successive similar-size donor sections or patches (not shown). Each one of the series has three different primary color patches, such as a yellow color patch, a magenta color patch and a cyan color patch, and a transparent colorless laminating patch immediately following the cyan color patch. All four donor patches are used once to make a single print. Also, loaded in the printer 10 is a rotated paper supply roll 20 including a paper web 22. The paper web 22 is a dye receiver web.

The printer 10 comprises:

- a donor roll mark (optical) sensor 24 for sensing coaxial code marks 26 on the rotated donor supply roll 16 to determine the roll speed/existing roll diameter and the size, i.e. width W×length L in inches ("), of each donor patch on the donor web 14, using a suitable programmed computer 28;
- a light emitter 30, such as a light-emitting diode, and a known light-responsive detector 32 that constitute a leading patch edge sensor for sensing successive leading edges of the four donor patches used to make a single print;
- a counter (not shown) in the computer 28 for counting each patch when its leading edge is sensed by the leading patch edge sensor 30, 32, and which is reset to zero ("0") whenever the cartridge 10 is removed from the printer 10 or a new print-making operation is begun;
- a print head 34 for heat-transferring the yellow, magenta, and cyan color dyes, and the laminating material, from the four donor patches to the same length of the paper web 22 as previously described in the "BACKGROUND OF THE INVENTION";
- a paper roll mark (optical) sensor 36 for sensing coaxial code marks 38 on the rotated paper supply roll 20 to determine the roll speed/existing roll diameter and the paper width W in inches ("), using the computer 28;
- a paper cutter 40 for severing a print length from the paper web 22 once the yellow, magenta, and cyan color dyes, and the laminating material, are heat-transferred from the four donor patches to the same length of the paper web 22;
- a paper cut (switch) sensor 42 for sensing each paper cut;
- a paper roll removal (switch) sensor 44 for sensing removal of the paper supply roll 20;
- a counter (not shown) in the computer 28 for counting each paper cut, and which is reset to zero ("0") whenever the paper supply roll 20 is removed from the printer 10 or a new print-making operation is begun; and
- a guide roller 46 for the donor web 14, a support roller 48 (movable towards and away from the printer head 34) for the donor web as well as for the paper web 22, a pinch roller 50 and a capstan roller 52 for the donor and paper webs, and guide roller 54 for the donor web.

The donor roll mark sensor 24, the light emitter 30, the light-responsive detector 32, the paper roll mark sensor 36, the paper cut sensor 42, and the paper roll removal sensor 44 are individually connected to a circuit board 56 which in turn is connected to the computer 28. A single-direction motor (not shown) is connected to the donor supply roll 16 for rotating it in unwinding direction, and a single-direction motor is connected to the rotated donor take-up roll 18 for rotating it in a winding direction. A bi-direction motor (not shown) is connected to the rotated paper supply roll 20 for rotating it in an unwinding direction. A bi-directional motor (not shown) is connected to the capstan roller 52 for rotating it in forward and reverse directions. All of the motors are connected to the computer 28.

Figure 2:
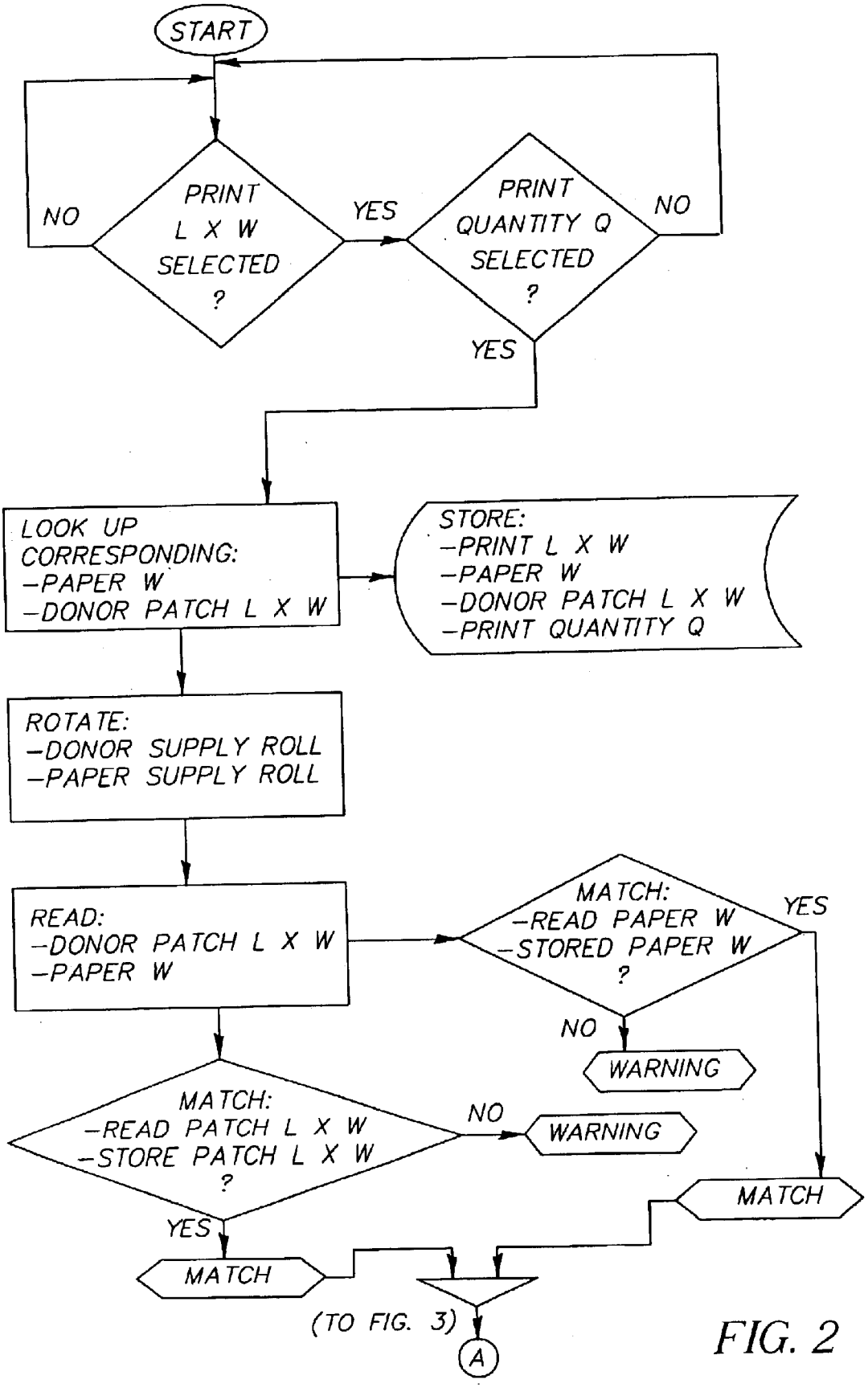
FIGS. 2–4 is a flow chart depicting a method operating the printing apparatus.
Figure 3:
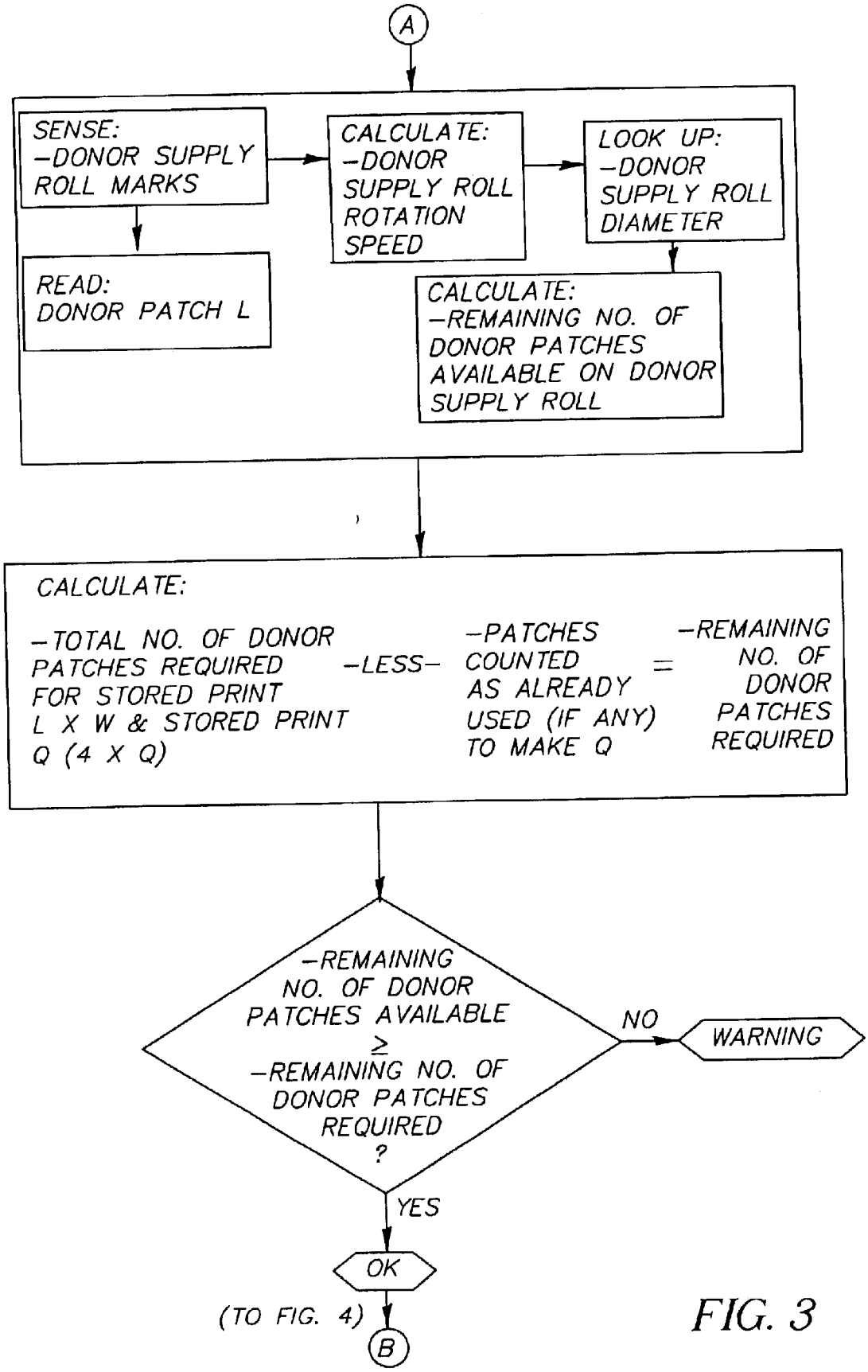
Figure 4:
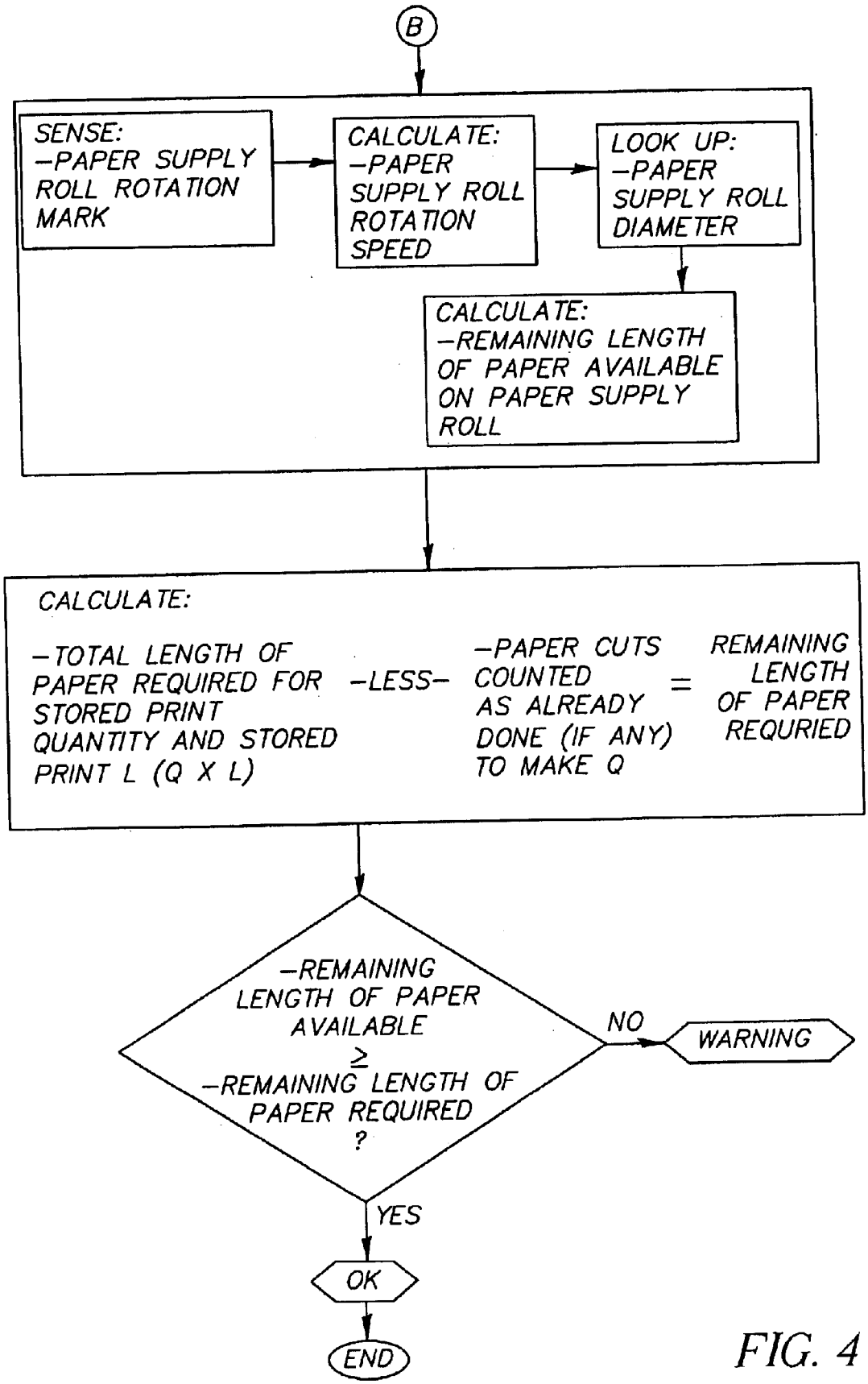

Method—FIGS. 2, 3 and 4

To start (FIG. 2) a cycle for the print-making operation the decision is made in the computer 28 whether a print size W×L in inches (") and a print quantity Q have been manually selected. If both are selected, the computer 28 determines the paper width W in inches and the donor patch size W×L in inches corresponding to the selected print size W×L by going to a look-up table. Then, the print L×W, the paper W, the donor patch L×W, and the print quantity Q are stored in a memory in the computer 28.

By way of example, a suitable look-up table in the computer 28 for the paper width W and the donor patch size W×L corresponding to the selected print size W×L is

| Selected Print W × L | Corresponding Paper W | Corresponding Donor Patch W × L |
|---|---|---|
| 5" × 3.5" | 5" | 5.25" × 4" |
| 5" × 7' | 5" | 5.25" × 7.5" |
| 6" × 4" | 6" | 6.25" × 4.5" |
| 6" × 8" | 6" | 6.25" × 8.5" |

Next (FIG. 2), the motors are energized to rotate the donor supply and take-up rolls 16 and 18, the paper supply roll 20, and the capstan roller 52, to advance the donor web 14 off the rotated donor supply roll and to advance the paper web 22 off the rotated paper supply roll.

Next (FIG. 2), the donor roll mark sensor 24 senses the code marks 26 on the rotated donor supply roll 16 to determine the size, i.e. width W×length L in inches ("), of each donor patch on the donor web 14, using the computer 28, and the paper roll mark sensor 36 senses the code marks 38 on the rotated paper supply roll 20 to determine the paper width W in inches ("), using the computer. Then, the decision is made in the computer 28 whether the sensed donor patch L×W matches the stored (in the memory) donor patch L×W, and whether the sensed paper W matches the stored (in the memory) paper width W. If the answer is "no" for one or both inquiries, a "warning" is displayed and the cycle is discontinued—in which case the donor supply roll 16 and/or the paper supply roll 20 have to be replaced to provide a match or matches with the selected print L×W. If the answer is "yes" for both inquiries, a "match" is displayed in both cases and the cycle is continued.

Next (FIG. 3), the donor roll mark sensor 24 senses the code marks 26 on the rotated donor supply roll 16, and the computer 28 uses this as timing information to first calculate the roll speed and then look up the corresponding roll diameter. Also, the donor roll mark sensor 24 senses the code marks 26 on the rotated donor supply roll 16 to determine the length L in inches ("), of each donor patch on the donor web 14. This, coupled with the looked up roll diameter, allows the computer 28 to estimate the remaining number of donor patches available on the donor supply roll 16.

At the same time or next (FIG. 3), the computer calculates the total number of donor patches required for the stored (in memory) print L×W and print quantity Q, i.e. 4×Q, and subtracts from 4×Q the patches counted as already used (if any, i.e. 1–3) to make Q, to determine the remaining (current) number of donor patches required to make Q.

Then (FIG. 3), the decision is made in the computer 28 whether the estimated remaining number of donor patches available on the donor supply roll 16 is not less than the determined remaining (current) number of donor patches required to make Q. If the former number is less than the latter number, a "warning" is displayed and the cycle is discontinued—in which case the short supply must be replenished. Otherwise, an "OK" is displayed and the cycle is continued.

Next (FIG. 4), the paper roll mark sensor 36 senses the code marks 38 on the rotated paper supply roll 20, and the computer 28 uses this as timing information to first calculate the roll speed and then look up the corresponding roll diameter. This allows the computer 28 to estimate the remaining length of paper available on the paper supply roll 20.

At the same time or next (FIG. 4), the computer calculates the total length of paper required for the stored (in memory) print L×W and print quantity Q, i.e. L×Q, and subtracts from L×Q the paper cuts counted as already done (if any) to make Q, to determine the remaining (current) length of paper required to make Q.

Then (FIG. 4), the decision is made in the computer 28 whether the estimated remaining length of paper available on the paper supply roll 20 is not less than the determined remaining (current) length of paper required to make Q. If the former number is less than the latter number, a "warning" is displayed and the cycle is discontinued—in which case the short supply must be replenished. Otherwise, an "OK" is displayed and the cycle is then completed.

The invention has been described in detail with particular reference to certain preferred embodiments thereof, but it will be understood that variations and modifications can be effected within the spirit and scope of the invention.

PARTS LIST

10. thermal printer
12. cartridge
14. donor web
16. donor supply roll
18. donor take-up roll
20. paper supply roll
22. paper (receiver) web
24. donor roll mark sensor
26. donor roll code marks
28. programmed computer
30. light emitter
32. light-responsive detector
34. print head
36. paper roll mark sensor
38. paper roll code marks
40. paper cutter
42. paper cut sensor
44. paper roll removal sensor
46. guide roller
48. support roller
50. pinch roller
52. capstan roller
54. guide roller
56. circuit board

What is claimed is:

1. A method of determining a mismatch involving the availability of a dye donor supply and a dye receiver supply in a thermal printer when a particular print size and print quantity are selected, comprising:

comparing a remaining number of similar-size donor patches available on the dye donor supply with a remaining number of like-size donor patches required for the selected print size and print quantity, and should the former number be less than the latter number providing a warning; and comparing a remaining length of dye receiver available on the dye receiver supply with a remaining length of dye receiver required for the selected print size and print quantity, and should the former length be less than the latter length providing a warning.

2. A method as recited in claim 1, wherein the dye donor supply is a rotated donor supply roll and the remaining number of donor patches available on the rotated donor supply roll is estimated by sensing coaxial code marks on the rotated donor supply roll to determine the roll speed and the length of each donor patch on the rotated donor supply spool.

3. A method as recited in claim 2, wherein the existing diameter of the rotated donor supply roll is determined from the roll speed in order to estimate the remaining number of donor patches available on the rotated donor supply roll.

4. A method as recited in claim 2, wherein the remaining number of donor patches required for the selected print size and print quantity is the number of donor patches required for the selected print size and print quantity less any donor patches counted as being used.

5. A method as recited in claim 1, wherein the dye receiver supply is a rotated receiver supply roll and the remaining length of dye receiver available on the rotated receiver supply roll is estimated by sensing coaxial code marks on the rotated receiver roll to determine the roll speed.

6. A method as recited in claim 5, wherein the existing diameter of the rotated receiver supply roll is determined from the roll speed in order to estimate the remaining length of dye receiver available on the rotated receiver supply roll.

7. A method as recited in claim 5, wherein the remaining length of dye receiver required for the selected print size and print quantity is the total actual length of dye receiver on the rotated receiver supply roll required for the selected print size and print quantity less any receiver-length cuts counted as being done.

8. A method as recited in claim 1, wherein the dye donor supply is a rotated donor supply roll, and said method further comprises:

sensing coaxial code marks on the rotated donor supply roll to determine the size of donor patches on the rotated donor supply roll; and comparing the size of donor patches on the rotated donor supply roll with the size of donor patches required for the selected print size, and should the former size not match the latter size providing a warning.

9. A method as recited in claim 8, wherein the dye receiver supply is a rotated receiver supply roll, and said method further comprises:

sensing coaxial code marks on the rotated receiver supply roll to determine the width of dye receiver on the rotated receiver supply roll; and comparing the width of dye receiver on the rotated receiver supply roll with the width of dye receiver required for the selected print size, and should the former width not match the latter width providing a warning.

10. Apparatus for of determining a mismatch involving the availability of a dye donor supply and a dye receiver supply in a thermal printer when a particular print size and print quantity are selected, comprising:

means for comparing a remaining number of similar-size donor patches available on the dye donor supply with a remaining number of like-size donor patches required for the selected print size and print quantity, and should the former number be less than the latter number providing a warning; and means for comparing a remaining length of dye receiver available on the dye receiver supply with a remaining length of dye receiver required for the selected print size and print quantity, and should the former length be less than the latter length providing a warning.

11. Apparatus as recited in claim 10, further comprising:

means for sensing code marks on the dye donor supply to determine the size of donor patches on the dye donor supply and for sensing coaxial code marks on the dye receiver supply to determine the width of dye receiver on the dye receiver supply; and means for comparing the size of donor patches on the dye donor supply with the size of donor patches required for the selected print size, and should the former size not match the latter size providing a warning, and for comparing the width of dye receiver on the dye receiver supply with the width of dye receiver required for the selected print size, and should the former width not match the latter width providing a warning.

* * * * *